United States Patent [19]

Tanabe et al.

[11] Patent Number: 4,462,367

[45] Date of Patent: Jul. 31, 1984

[54] FUEL CONTROLLER FOR INTERNAL COMBUSTION ENGINE

[75] Inventors: Yoshiyuki Tanabe; Mineo Kashiwaya; Akira Hikichi; Yoshikazu Aochi, all of Katsuta, Japan

[73] Assignee: Hitachi, Ltd., Tokyo, Japan

[21] Appl. No.: 471,436

[22] Filed: Mar. 2, 1983

[30] Foreign Application Priority Data

Mar. 4, 1982 [JP] Japan ..... 57-34929

[51] Int. Cl.[3] ..... F02B 29/2

[52] U.S. Cl. ..... 123/442; 123/308

[58] Field of Search ..... 123/442, 308, 124 R, 123/26, 337, 309, 52 MB, 52 M; 261/23 A, 39 A, 65

[56] References Cited

U.S. PATENT DOCUMENTS

| | | | |
|---|---|---|---|
| 3,721,428 | 3/1973 | Gelé et al. | 123/442 |
| 4,214,561 | 7/1980 | Matsumoto et al. | 123/442 |
| 4,317,438 | 3/1982 | Yagi et al. | 123/308 |
| 4,323,038 | 4/1982 | Motosug et al. | 123/442 |
| 4,347,816 | 9/1982 | Saito et al. | 123/442 |

*Primary Examiner*—Raymond A. Nelli

*Attorney, Agent, or Firm*—Antonelli, Terry & Wands

[57] ABSTRACT

In a fuel controller which comprises; a venturi portion formed in an air-intake path adapted to feed air to an internal combustion engine; a throttle valve installed on the downstream side of the venturi portion; an auxiliary throttle valve and a fuel injection portion provided between the throttle valve and the venturi portion; a bypass air path opened at the venturi portion and at the upstream side thereof; a hot-wire type air flow sensor provided in the bypass air path for detecting an amount of air passing therethrough; and a proportional electromagnetic device which controls the amount of air passing through the bypass air path at a constant level with an air needle valve provided therein and which controls an amount of fuel passing through a fuel path corresponding to an amount of air passing through the air-intake path with a fuel needle valve provided in the fuel path communicating with the fuel injection portion, the auxiliary throttle valve and the throttle valve are operated interlockedly through a link mechanism.

5 Claims, 6 Drawing Figures

FUEL CONTROLLER FOR INTERNAL COMBUSTION ENGINE

FIELD OF THE INVENTION

This invention relates to an apparatus for feeding fuel to internal combustion engines, and more particularly to a fuel controller for automobiles which is adapted to regulate an amount of supplied fuel in an electronical manner.

BACKGROUND OF THE INVENTION

In general, there is known a fuel injection apparatus for internal combustion engine which feeds fuel from a single fuel injection portion to all cylinders of an internal combustion engine.

This known fuel injection apparatus for internal combustion engine is constructed as follows. A throttle valve is provided in an air-intake path connected to the upstream side of an air-intake tube meeting portion communicating with each cylinder, and a fuel injection portion is provided on the upstream side of this throttle valve. Also, an electromagnetic valve forming the fuel injection portion is driven by a pulse with a certain width to intermittently inject fuel into the air-intake path. This valve opening pulse is controlled in its width by an air-intake amount signal which is detected by an air flow meter provided in the air-intake path.

This known fuel injection apparatus has the following drawbacks:

(1) Since the fuel injection portion intermittently injects fuel into the air-intake path connected to the upstream side of the air-intake tube meeting portion, thick and thin air-fuel mixture portions are alternately formed between the air-intake path and the air-intake tube meeting portion, that is, the air-fuel mixture becomes ununiform in space. Thus, when the cylinders of the internal combustion engine sequentially intakes the air-fuel mixture, some cylinder intakes a thick mixture and another one does a thin mixture, that is, the distribution property of fuel is poor. This causes variation of torque in the internal combustion engine.

(2) Since the air flow meter is used to measure the amount of air intake and determine the valve opening pulse width over a wide range from idling drive to high-speed, high-load drive, the precision of the air flow meter is required over the wide range. In other words, the air flow meter must practically detect the true amount of air taken in the internal combustion engine over the wide range from idling drive to high-speed, high-load drive. This requires a high-precision air flow meter over a wide range and causes a signal processing circuit connected to the output of the air flow meter to be complicated in construction.

STATEMENT OF PRIOR APPLICATION

The applicant has previously proposed Japanese Patent Applications No. 55-188494 and No. 55-188495 (corresponding to U.S. Patent Application Ser. No. 333,296 filed on Dec. 22, 1981 and EPC Application No. 8111079914 filed on Dec. 28, 1981), which disclose therein such a fuel controller that a hot-wire type air flow sensor is provided within a bypass air path having one end opened at the upstream side of a venturi portion in an air-intake path and the other end opened at the venturi portion, output from this hot-wire type air flow sensor is fed back to control an amount of air passing through the bypass air path at a substantially constant level by means of an air regulating valve, and a fuel amount fed to an engine is controlled by means of an electromagnetic device which drives the air regulating valve.

The above patent applications also disclose therein such improvements in the fuel controller of this type as to correct the fuel amount during accelerating and decelerating drives and to promote atomization of the supplied fuel into fine particles. With this, a carburetor can ensures higher accuracy in its electronic fuel control. For example, an auxiliary throttle valve provided within the air-intake path is formed of a butterfly valve which is asymmetrical in the right and left direction and fixed onto a shaft extending through the center of the air-intake path. An opening degree of the butterfly valve is easily varied in accordance with the flow rate of intake air thereby to increase a speed of running air through the fuel injection apparatus, so that fuel is promoted to be atomized into fine particles. During idling drive, the auxiliary throttle valve is made to hold its horizontal posture by means of a counter weight attached to a shaft of the valve.

However, such auxiliary throttle valve is easily rocked upon vibrations while traveling or attendant on revolutions of an engine, and this causes the speed of running air through the fuel injection apparatus to be fluctuated. At this time, an amount of fuel injected and supplied to the fuel injection apparatus is also fluctuated, thus resulting in such a drawback that revolutions of the engine become unstable.

SUMMARY OF THE INVENTION

It is an object of this invention to provide a fuel controller for internal combustion engine which can eliminate the above-mentioned drawbacks in the prior art.

According to this invention, the foregoing object is achieved by such a fuel controller that a throttle valve and an auxiliary throttle valve are coupled to each other with a link mechanism so as to increase or decrease opening degrees of both throttle valves interlockedly, and hence the opening degree of the auxiliary throttle valve is made not to fluctuate due to vibrations, thus ensuring stable feeding of fuel.

DETAILED DESCRIPTION OF THE INVENTION

Figure 1:
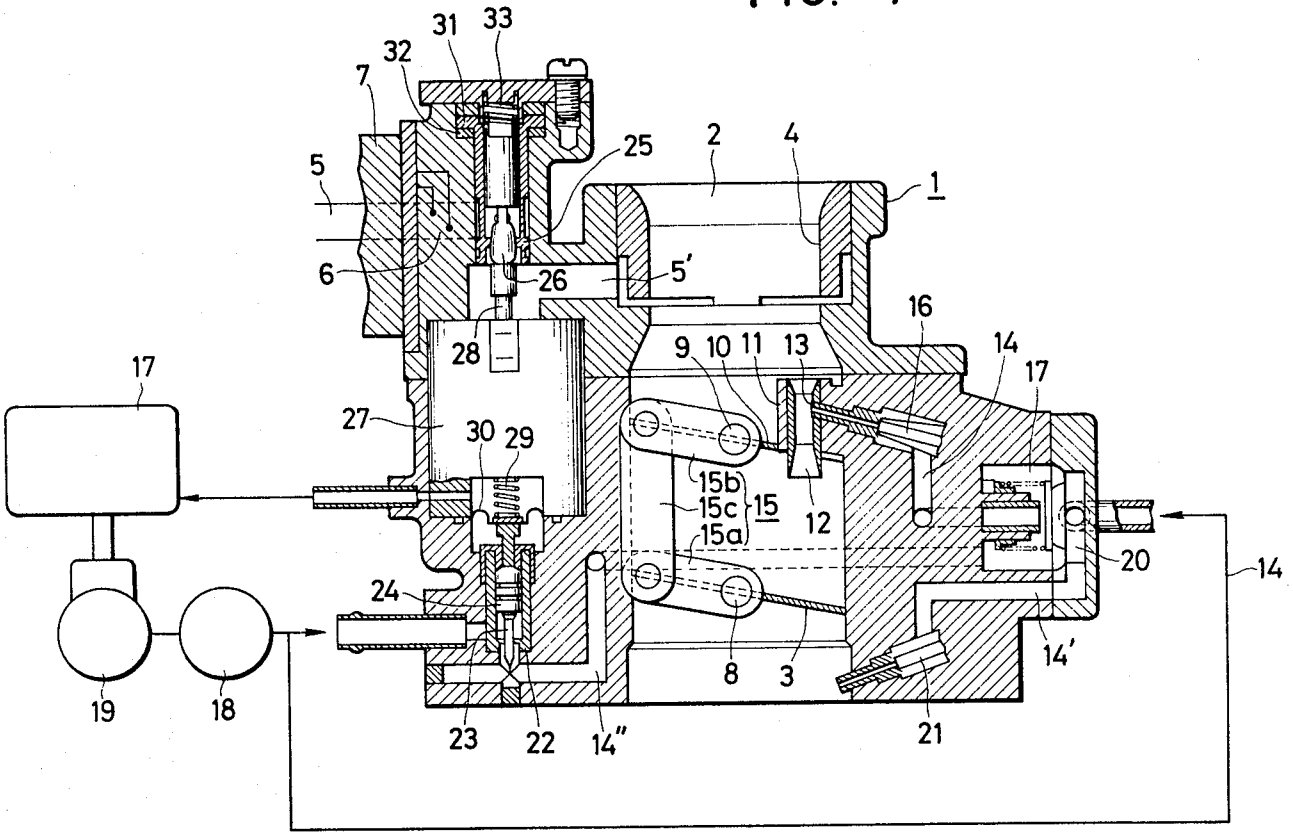
FIG. 1 is a sectional view showing a fuel controller for internal combustion engine according to one embodiment of this invention.

Referring to FIG. 1 there is shown a fuel controller according to this invention, a throttle valve 3 is installed in an air-intake path 2 of a carburetor 1 and a venturi portion 4 is formed on the upstream side of the throttle valve 3. The air-intake path 2 between the venturi portion 4 and the throttle valve 3 is partially projected so as to constitute a fuel injection portion 11 which includes a small venturi 12 in the direction of an intake air current.

Figure 2:
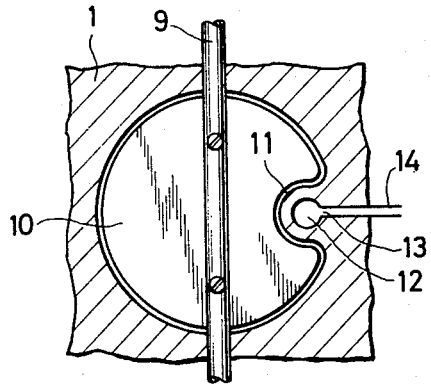
FIG. 2 is an enlarged plan view showing a fuel injection portion of the fuel controller shown in FIG. 1.

Also referring to FIG. 2, a fuel path 14 formed in a body of the carburetor 1 is opened to the interior of the small venturi 12 through a nozzle 13, thereby to constitute the fuel injection portion 11 together with the small venturi 12. An auxiliary throttle valve 10 is installed in the air-intake path 2 near the fuel injection portion 11 through an auxiliary throttle valve shaft 9. The auxiliary throttle valve 10 is partially cut out corresponding to the projected fuel injection portion 11 to make its shape coincident with a sectional shape of the air-intake path 2, so that most area of the air-intake path 2 is closed by the auxiliary throttle valve 10 during such drive as to require a small amount of air-intake, and hence intake air is allowed to pass only through the small venturi 12. This results in such an advantage that atomization of fuel into fine particles can be achieved even with the small amount of air intake.

As will be seen from FIG. 1, the valve shaft 9 mounting thereon the auxiliary throttle valve 10 is coupled to a valve shaft 8 mounting thereon the throttle valve 3 with a link mechanism 15. More specifically, an arm 15*b* having one end fixed to the valve shaft 9 for the auxiliary throttle valve 10 and an arm 15*a* having one end fixed to the valve shaft 8 for the throttle valve 3 are disposed in parallel and coupled to an arm 15*c* by means of pins. Therefore, when an opening degree of the throttle valve 3 is changed, an opening degree of the auxiliary throttle valve 10 is also changed by the same angle.

Figure 3:
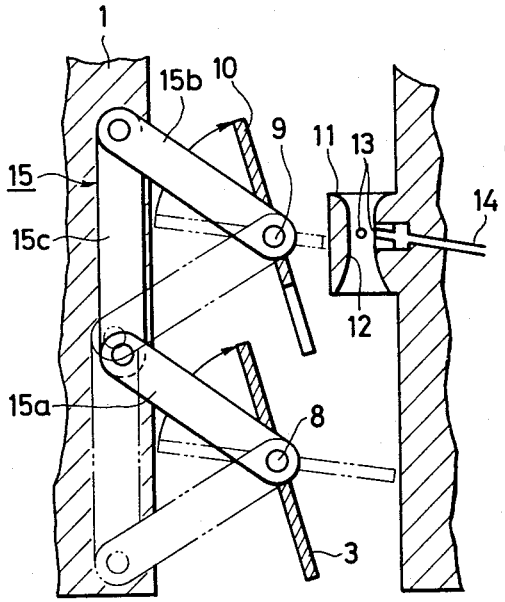
FIG. 3 is an enlarged partial sectional view for explaining operation of a link mechanism of the fuel controller shown in FIG. 1.

Operation of the link mechanism 15 will be now described by referring to FIG. 3. The link mechanism 15 comprises three arms 15*a*, 15*b* and 15*c* as previously noted, and when an accelerator pedal mechanically connected to the valve shaft 8 for the throttle valve 3 is pressed down, its opening degree is increased as shown by solid lines. Also, when the acclerator pedal is released, the opening degree of the throttle valve 3 is automatically reduced by the action of a return spring (not shown) and returned to the state as shown by dotted lines. With this, a speed of intake air running through the fuel injection portion 11 is increased even during such drive as to require a small amount of air-intake, so that atomization of fuel into fine particles is promoted. In this connection, the nozzle 13 communicating with the fuel path 14 is provided in plural number each at a right angle with respect to the intake air current.

Now referring to FIG. 1 once again, the fuel path 14 is communicated with a fuel pump 19 through a deceleration solenoid valve 16, which is closed at the time of deceleration, and fuel pressure regulators 17, 18 (the latter regulator 18 is illustrated in the form of a block diagram), thereby to feed fuel controlled at pressure of about 0.7 Kg/cm$^2$. Another fuel path 14' communicating with a fuel chamber 20 on the high pressure side of the fuel pressure regulator 17 is communicated with an acceleration solenoid valve 21 so as to feed backup fuel to the downsteam side of the throttle valve 3 at the time of acceleration. Moreover, the fuel pressure regulator 17 is communicated with a fuel orifice 22 through a still another fuel path 14" (a part of which is shown by dotted lines) and a fuel chamber including the fuel orifice 22 is communicated with the fuel pressure regulator 18, whereby a pressure difference across a fuel needle valve 23 is held constant and hence fuel discharge pressure at the fuel injection portion 11 is maintained at a constant level.

The fuel needle valve 23 is inserted into the fuel orifice 22 to adjust its opening area for controlling an amount of fuel supplied to the fuel injection portion 11. The fuel needle valve 23 is provided with a plurality of flanged portions 24 which constitute a labyrinth seal. On the other hand, an air orifice 25 and an air needle valve 26 for varying an opening area of the air orifice 25 are provided in a bypass air path 5 on the downstream side 5' of a hot-wire type air flow sensor 6. The upstream side of the bypass air path 5 is communicated with the upstream side of the venturi portion 4, for example, an air cleaner. Then, the pair of the fuel orifice 22 and the fuel needle valve 23, the pair of air orifice 25 and the air needle valve 26, and a proportional electromagnetic device 27 are disposed to align on the same axis. Thus, shafts 28 and 29 of the proportional electromagnetic device 27 are enable to drive the air needle valve 26 and the fuel needle valve 23, respectively. Besides, a bellows diaphragm 30 is attached to the shaft 29 for driving the fuel needle valve 23 and it is secured to the body of the carburetor 1, thereby to prevent fuel from leaking to the outside of the body.

Furthermore, the air orifice 25 is constituted to be movable in the same direction as the displacing direction of the air needle valve 26. More specifically, the air orifice 25 is formed in unison with an orifice holder 31. By changing a thickness of a washer 32 interposed between the orifice holder 31 and the carburetor body 31, the air orifice 25 can be moved and adjusted in the same direction as the displacing direction of the air needle valve 26. Within the orifice holder 31 there is installed a spring 33 adapted to impart a set load to the air needle valve 26.

The deceleration solenoid valve 16 installed in the fuel path 14 leading to the fuel injection portion 11 functions to close the fuel path 14 at the time of deceleration so as to stop fuel injection from the fuel injection portion 11 and hence prevent generation of too thick air-fuel mixture. Also, as previously noted, the acceleration solenoid valve 21 is installed at the downstream side of the throttle valve 3, so that backup fuel is directly supplied to an intake manifold at the time of acceleration.

Figure 4:
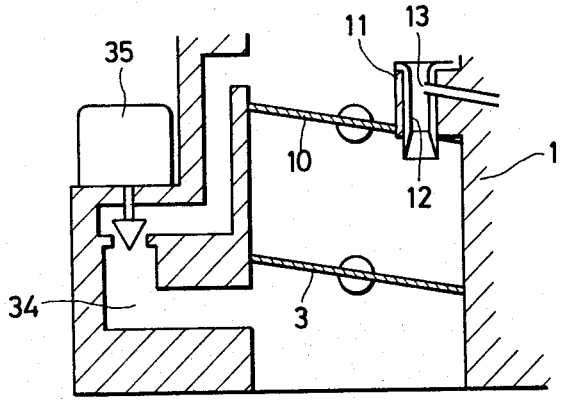
FIG. 4 is a sectional view of an essential part of the fuel controller, for explaining an air backup path while idling.

Now referring to FIG. 4 there is shown an air backup means during idling drive, the opening degrees of both auxiliary throttle valve 10 and throttle valve 3 become small during such drive and flow of intake air is interrupted in a double manner. Also, the small venturi 12 of the fuel injection portion 11 has a small opening area originally. Therefore, air supply is liable to be insufficient during idling drive. In order to avoid such shortage in air supply, a correction air path 34 is formed in the carburetor body 1 bypassing both auxiliary throttle valve 10 and throttle valve 3, and at the same time an idling drive control valve 35 is opened.

Figure 5:
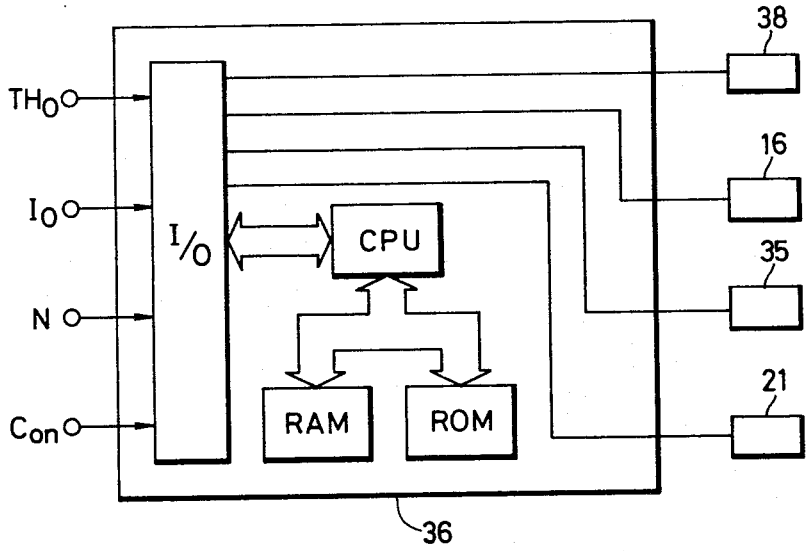
FIG. 5 is a circuit diagram showing a control means for the fuel controller shown in FIG. 1.

As shown in FIG. 5, a signal THo from a throttle valve opening degree sensor for detecting the accleration state, an signal Io from an idling opening degree switch for detecting the deceleration state, a signal N from a detector for detecting speeds of an engine crank, and a signal Con from a cooler switch are input to a computer 36. Other operation parameters for the engine may be input thereto for additional various corrections on demand. These signals are subject to arithmetic processing in the computer 36 and then outputs therefrom are fed to a drive circuit 38 for the proportional electromagnetic device 27 as shown in FIG. 6, the deceleration solenoid valve 16, the idling drive control valve 35 and the acceleration solenoid valve 21.

A signal sent to the idling drive control valve 35 is in the form of a duty pulse signal which is controlled in its on-time for each period, while other signals sent to the solenoid valves are in the form of an on-off signal. Further, a signal sent to the proportional electromagnetic device 27 is first input to a comparator 37 including a differential amplifier to be compared with a preset level and then output from the comparator 37 is fed to the device 27.

Figure 6:
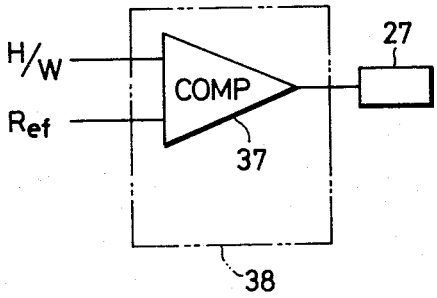
FIG. 6 is a circuit diagram showing a drive circuit for a proportional electromagnetic device shown in FIG. 5.

FIG. 6 shows a diagram of the drive circuit 38 for the proportional electromagnetic device in FIG. 5. More specifically, an air flow signal H/W from the hot-wire type air flow sensor 6 shown in FIG. 1 is compared with the preset level Ref by the comparator 37 including a differential amplifier. When there occurs a difference therebetween, the controller functions to reduce the difference value. That is, the comparator 37 outputs such a signal as allowing the signal H/W to approach the preset level Ref. In other words, this signal permits the proportional electromagnetic device 27 to control an opening area which is defined by the air needle valve 26 and the air orifice 25, so that an amount of air passing through the bypass air path 5 is held substantially constant.

The manner of operation of the fuel controller thus constructed will be described hereinafter. When the engine starts to be driven, air is made to flow through the air-intake path 2 and there occurs a pressure difference between the venturi portion 4 and the upstream side of the venturi portion 4. Thus, air flows into the venturi portion 4 from the upstream side thereof through the bypass air path 5. Upon this, the hot-wire type air flow sensor 6 starts to detect the air flow rate. The output signal H/W from the hot-wire type air flow sensor 6 is compared with the preset level Ref in the comparator 37 as shown in FIG. 6. When the throttle valve 3 is closed and negative pressure produced at the venturi portion 4 becomes small, a value of the signal H/W from the hot-wire type air flow sensor 6 is lowered less than the preset level Ref, whereupon the proportional electromagnetic device 27 controls an opening time of the air needle valve 26 so that an amount of air passing through the opening defined by the air needle valve 26 and the air orifice 25 is increased to reach the preset level Ref. Stated differently, the drive circuit 38 gives the proportional electromagnetic device 27 with a pulse having such duty as to increase the opening time of the air needle valve 26. At this time, an opening area defined by the fuel needle valve 23 and the fuel orifice 22 is reduced so as to decrease a fuel supply amount in accordance with the reduction in amount of air-intake to the engine attendant on closing of the throttle valve 3. It is also a matter of course that a shape of the fuel needle valve 23 is determined to make the then air-fuel ratio close to the theoretical air-fuel ratio on this occasion.

To the contrary, when the opening degree of the throttle valve 3 is enlarged and the amount of air-intake becomes larger, negative pressure produced at the venturi portion 4 is increased and, as a result, an amount of air passing through the bypass air path 5 becomes larger. Thus, the value of the signal H/W from the hot-wire type air flow sensor 6 exceeds the preset level Ref, whereupon the proportional electromagnetic device 27 controls the air needle valve 26 so that an amount of air passing through the opening difined by the air needle valve 26 and the air orifice 25 is reduced to approach the preset level Ref. Stated differently, the drive circuit 38 gives the proportional electromagnetic device 27 with a pulse having such duty as to raise the air needle valve 26 upward. At this time, the opening area defined by the fuel needle valve 23 and the fuel orifice 22 is changed so as to increase a fuel supply amount in accordance with the increase in amount of air-intake to the engine attendant on opening of the throttle valve 3. It is also a matter of course, as previously noted, that a shape of the fuel needle valve 23 is determined to make the then air-fuel ratio close the the theoretical air-fuel ration on this occasion.

By repeating the above-mentioned operation, feedback control is carried out to ensure that an amount of air passing through the bypass air path 5 is held substantially constant by the proportional electromagnetic device 27 which controls the air needle valve 26. With such feedback control, a change in amount of air-intake to the engine is continuously grasped, and then the air needle valve 26 is driven correspondingly so as to control the air-fuel ratio of mixture supplied to the engine substantially at the theoretical air-fuel ratio. As an alternative, the value of preset level may be changed to control the air-fuel ratio at that other than the theoretical air-fuel ratio.

In the fuel controller according to this invention wherein fuel is injected to the upstream side of the throttle valve 3, the opening degree of the throttle valve is reduced during idling drive and hence an area of path through which the air-fuel mixture passes becomes small. Thus, if fuel is not atomized sufficiently into fine particles, the mixture supplied to the engine would be made too thick or thin. How to solve this problem is the most important point in the fuel controller of this kind. According to this invention, the problem is solved completely such that fuel supplied during idling drive is atomized into fine particles through the fuel injection portion 11 and shortage of the air-intake amount is compensated by backup air fed through the adling drive control valve 35.

Also, in the fuel controller of this invention, since the throttle valve 3 and the auxiliary throttle valve valve 10 are coupled to each other with the link mechanism 15 and the latter valve is opened or closed in interlock with the opening degree of the former valve, the opening degree of the auxiliary throttle valve is not fluctuated due to vibrations unlike the prior art, thus resulting in stable feeding of fuel. Consequently, it becomes possible to attain better drivability and to achieve such advantages as improved compositions of exhaust gas and a reduction of fuel consumption.

What we claim:

1. A fuel controller for controlling fuel supply to an internal combustion engine comprising;

a venturi portion formed in an air-intake path adapted to feed air to said internal combustion engine;

a throttle valve installed in said air-intake path on the downstream side of said venturi portion;

an auxiliary throttle valve installed between said throttle valve and said venturi portion;

a fuel injection portion provided between said throttle valve and said venturi portion and injecting fuel fed through a fuel path;

a bypass air path formed to have one end opened at said venturi portion and the other end opened at the upstream side thereof;

a sensor means provided in said bypass air path for detecting an amount of air passing therethrough;

a means provided in said bypass air path for controlling the amount of air passing therethrough at a constant level;

a means provided in a fuel path communicating with said fuel injection portion for controlling an amount of fuel passing through said fuel path in accordance with the amount of air passing through said air-intake path; and a link mechanism for operating said auxiliary throttle valve and said throttle valve interlockedly.

2. A fuel controller according to claim 1, said sensor means adapted to detect the amount of air passing through said bypass air path being of a hot-wire type air flow sensor.

3. A fuel controller according to claim 1, wherein said means for controlling the amount of air passing through said bypass air path at a constant level and said means for controlling the amount of fuel passing through said fuel path are formed of an air needle valve and a fuel needle valve, respectively.

4. A fuel controller according to claim 3, which includes a proportional electromagnetic device for controlling said air needle valve and said fuel needle valve.

5. A fuel controller according to claim 1, said link mechanism comprising an arm portion having one end connected to said throttle valve, an arm portion having one end connected to said auxiliary throttle valve, and an arm portion having both ends connected to the opposite ends of said two arm portions respectively.

* * * * *